United States Patent [19]

Larin

[11] 4,184,277

[45] Jan. 22, 1980

[54] LOCKABLE NAME PLATE

[75] Inventor: Jean Larin, Montreal, Canada

[73] Assignee: Emboss-O-Prestige LTEE, Longueuil, Canada

[21] Appl. No.: 911,877

[22] Filed: Jun. 2, 1978

Related U.S. Application Data

[63] Continuation of Ser. No. 723,468, Sep. 15, 1976, abandoned.

[30] Foreign Application Priority Data

Jul. 23, 1976 [CA] Canada ..... 257652

[51] Int. Cl.[2] ..... G09F 7/04; G09F 7/10

[52] U.S. Cl. ..... 40/10 R; 40/490; 40/600; 40/621; 70/276

[58] Field of Search ..... 40/10 R, 585, 621, 1.5, 40/1.6, 15, 16.6, 200, 490, 611, 618, 600; 273/156; 70/276, 413; 206/1.5; 46/236; 24/201 B; 292/251.5

[56] References Cited

U.S. PATENT DOCUMENTS

| | | | |
|---|---|---|---|
| 511,167 | 12/1893 | Shaffer et al. | 70/276 |
| 767,298 | 8/1904 | Louis | 70/276 |
| 1,542,789 | 6/1925 | Mackintosh | 40/585 |
| 2,009,905 | 7/1935 | Rankin | 206/1.5 |
| 2,901,278 | 8/1959 | Robinson | 24/201 B |
| 3,393,541 | 7/1968 | Wake | 70/276 |
| 3,650,379 | 3/1972 | Montagne | 206/1.5 |
| 3,684,292 | 8/1972 | Penrod et al. | 273/156 |
| 3,736,779 | 6/1973 | Pratt | 70/276 |
| 3,744,833 | 7/1973 | Berducone | 292/251.5 |

FOREIGN PATENT DOCUMENTS

| | | | |
|---|---|---|---|
| 18859 | of 1899 | United Kingdom | 70/276 |
| 200611 | 7/1923 | United Kingdom | 40/10 R |

OTHER PUBLICATIONS

"Magnetic Lock", Popular Science, 2-1951, pp. 219-220.

*Primary Examiner*—Russell R. Kinsey
*Assistant Examiner*—John J. Wilson
*Attorney, Agent, or Firm*—Larson, Taylor and Hinds

[57] ABSTRACT

A name plate assembly having invisible locking means requiring the use of an externally applied magnet.

The name plate assembly includes the use of a base member having one or more dovetailed type rails on one face and a game plate having corresponding dovetail recesses for slidingly engaging with the rails of the base member. Mounted on the base member is a first magnet means which normally engage with the name plate to hold the name plate locked securely on the base member. The magnet means can only be disengaged from the name plate by the application to the assembly of a second magnet means withdrawing the first magnet means from locking engagement with the name plate.

1 Claim, 17 Drawing Figures

LOCKABLE NAME PLATE

This is a continuation of application Ser. No. 723,468 filed Sept. 15, 1976 and now abandoned.

This invention relates to name plate assemblies and particularly to name plates which are slidably mounted on a base and have invisible locking means controlled by the use of a magnet or a system of magnets.

Name plates, particularly those which are mounted on a base secured to a door or wall and those which are mounted on a directory board, are readily subjected to unwarranted removal. This is particularly so with name plates which can readily be used by others. The unauthorized removal of name plates has led to considerable inconvenience and expense in providing replacements.

The invention consists of a name plate mounted on a base together with magnet means whereby the name plate is secured to the base and is releasable from the base only when the magnet means is made operable by an authorized person. In one example, the name plate base has dovetailed rails on its frame face and the name plate has dovetailed rails on its rear face, the dovetailed rails engaging with each other to permit the name plate to be slidably mounted on the base. One or more metal dowels or magnets are floatably mounted in cavities, half of which are located on the front face of the name plate base with the other half being located on the rear face of the name plate. The two facing halves of the cavities are aligned with each other when the name plate is in its proper position on the name plate base. The metal dowels or magnets are floatably captive in the name plate base and partially drop into engagement in the cavity in the name plate only when the name plate is slidably moved along the base to take up its desired position. In order to permit the name plate to be withdrawn from the base, an external magnet or magnet system must be applied to the upper edge or predetermined area of the base name plate assembly in order to raise or unlock the metal dowel or magnet out of the cavity in the name plate. While the metal dowel or magnet within the name plate assembly is in the raised or unlocked position, the name plate can be slid along and out of engagement with the base. Thus, without the use of an operative magnet, the name plate remains securely locked on the base.

In some applications of the invention where an electrical supply is available, such as for illuminating a directory panel board, electro-magnets can be employed for locking and unlocking the name plates on their base.

The present invention, therefore, provides a relatively cheap and practical means of protecting name plates from unwarrented removal from the base on which they are mounted.

The object of the invention is to provide a lockable name plate assembly in which the locking means is not visible and an external magnetic device suitably designed must be applied to a predetermined area of the assembly in order to remove the name plate from its base.

A further object of the invention is to provide a name plate assembly in which a name plate will automatically lock itself when repositioned on the base of the name plate assembly.

A further object of the invention is to provide means for locking a multiple of name plates on a base or directory board.

These and other objects of the invention will be apparent from the following detailed specification and the accompanying drawings in which.

Figure 5:
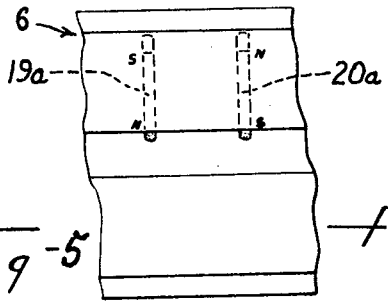
FIG. 5 is a partial front face view of a name plate base, showing an arrangement using a pair of opposing attraction locking magnets which require a special magnet to unlock the sliding name plate.
Figure 5A:
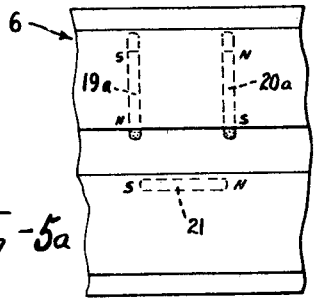

FIG. 5*a* is similar to FIG. 5, but shows a third magnet for holding the other two magnets in locking position when the name plate assembly is in a flat position.

Figures 6, 7, 8, 9, 10, 11, 12, 13, 14, 15, 16:
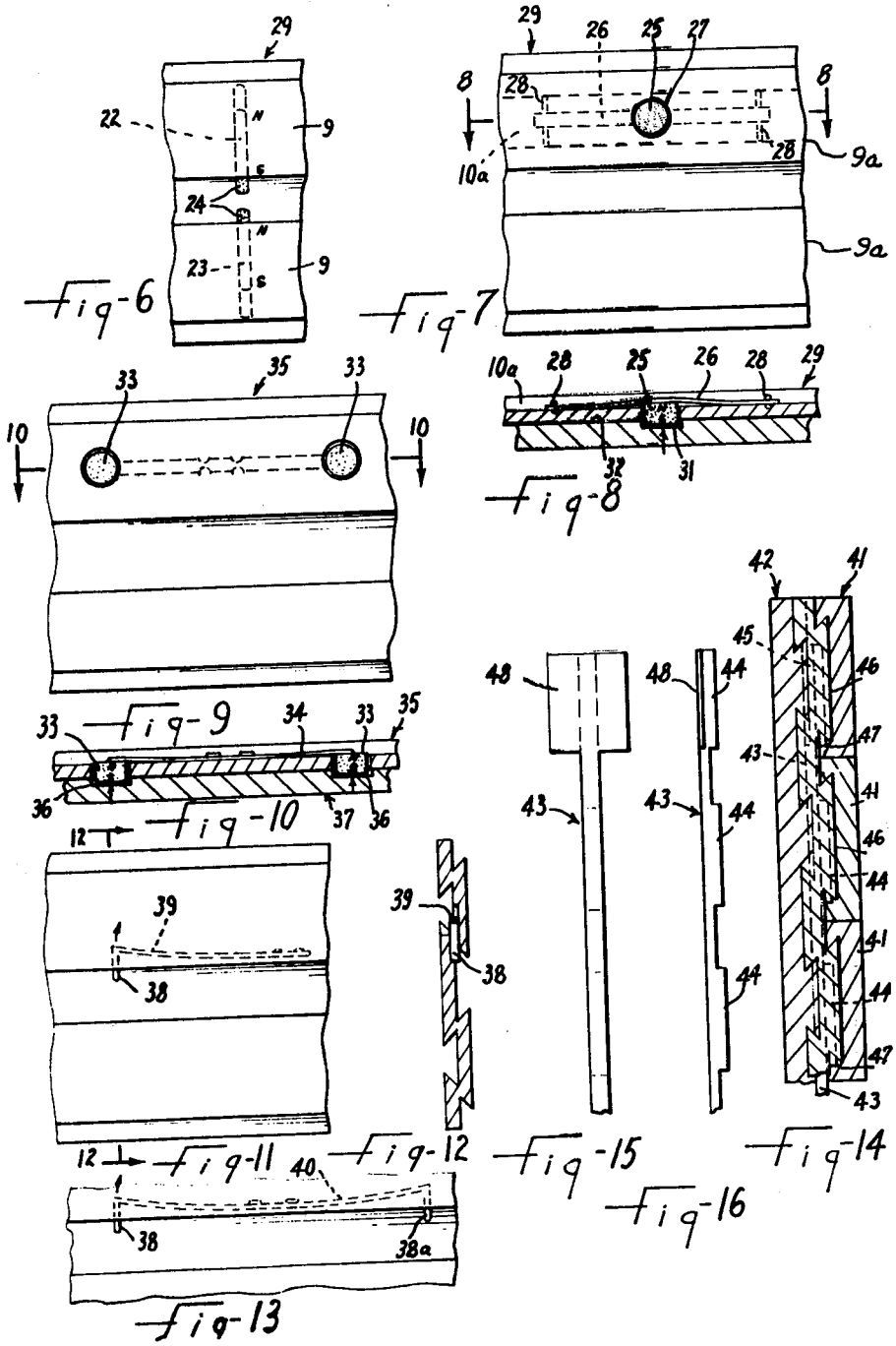

FIG. 6 is a partial front face view of a name plate base, showing a modified arrangement of the use of two magnets from that shown in FIG. 5 requiring a specially designed magnet to unlock the name plate.

FIG. 7 is a partial front face view of a name plate base, showing a spring mounted magnet requiring the use of a repulsion magnet applied to the front of the name plate assembly.

FIG. 8 is a horizontal section taken on the line 8—8 of FIG. 7.

FIG. 9 is a view similar to FIG. 7, but shows two spring mounted magnets requiring the use of a repulsion magnet as shown in FIG. 7.

FIG. 10 is a horizontal section taken on the line 10—10 of FIG. 9.

FIG. 11 is a view similar to FIG. 7, but shows a pin type magnet mounted on the end of a spring.

FIG. 12 is a vertical section taken on the line 12—12 of FIG. 11.

FIG. 13 is an arrangement similar to that shown in FIG. 11, but shows two magnets secured to each end of a spring.

FIG. 14 is a partial vertical section of a multiple name plate assembly employing a magnet and a gang dowel for locking the name plates.

FIG. 15 is a front view of the multiple dowel shown in FIG. 14.

FIG. 16 is a side view of the multiple dowel shown in FIG. 15.

Figure 1:
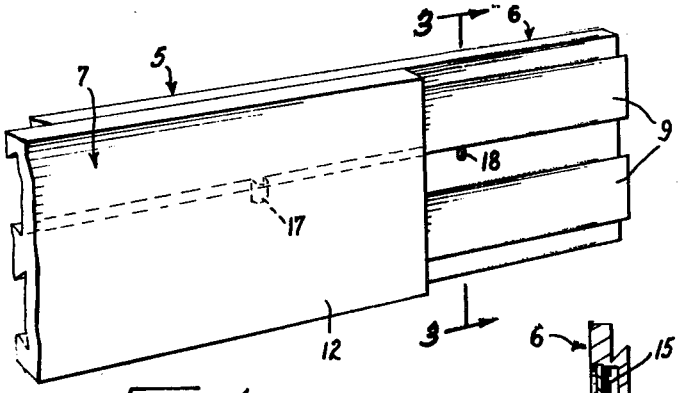
FIG. 1 is a part perspective view of a name plate assembly according to the present invention with the name plate moved along the base to show a magnet locking pin captive in the base.

Referring to the drawings and particularly to FIGS. 1 to 4. FIG. 1 is a partial perspective view of one end of a name plate assembly 5 of typical form which includes a base 6 and a name plate 7. The base 6 is preferably of extruded form having on its front face 8 a pair of dovetailed rails 9 and corresponding but smaller dovetail-shaped recesses 10 on its rear face 11. The name plate 7 has a flat front face 12 and on its rear face 13 there is provided a pair of dovetail-shaped recesses 14 adapted to fit on the rails 9 of the base 6 for sliding movement of the name plate 7 on the base 6.

At a distance inwards from one end of the base 6 there is drilled, or otherwise formed, a vertically disposed cavity 15 centrally disposed between the front face and the rear face of the base 6, the cavity 15 extending upwards behind the rail 9a and downwards to be exposed in the dovetail recess 10 located between the two rails 9.

The name plate 7, at the same distance inwards from the end of the name plate as the cavity 15 in the base 6, has a cavity 17 drilled, or otherwise formed, extending downwards from the lower edge 14*a* of the upper recess 14.

Figure 3:
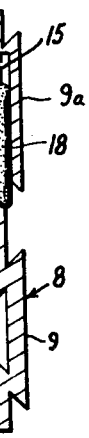
FIG. 3 is an enlarged vertical section taken on the line 3—3 of FIG. 1, showing the metal dowel or magnet locking pin located within a cavity in the base member of the name plate assembly.
Figure 4:
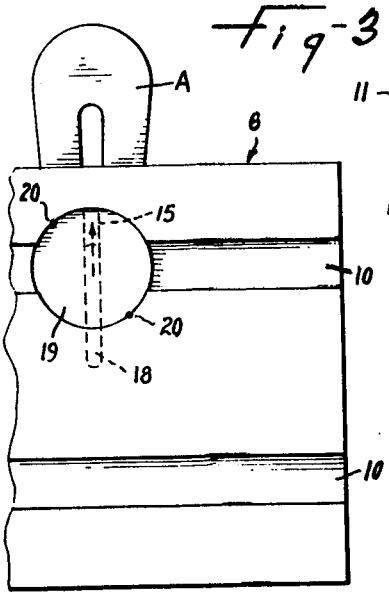
FIG. 4 is an enlarged rear view of one end of the name plate assembly, showing the means to hold the locking magnet captive and an external magnet to raise the locking dowel or magnet device out of interference with the name plate.

A floating magnet 18 is located in the cavity 15 in the base 6 and is held therein by the plug 19 set in the rear face of the base 6, as shown in FIGS. 3 and 4. The plug 19 is held in place by the detents 20.

Figure 2:
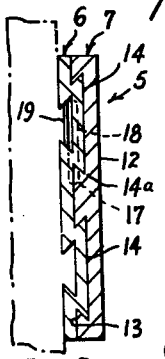
FIG. 2 is an end view of the assembly shown in FIG. 1, showing in dotted lines the metal dowel or magnet locking pin in interference with the name plate.

The cavity 15 in the base 6 and the cavity 17 in the name plate 7 are aligned with each other when the name plate 7 is aligned in its correct position on the base 6 and when the base and name plate assembly are positioned vertically when mounted on a door or in a directory stand, as shown in FIG. 2, the lower end of the magnet 18 drops into the cavity 17 in the name plate 7 to lock the name plate from horizontal movement relative to the base 6.

An external magnet A, shown in FIG. 4, is applied to the top edge of the name plate assembly for the purpose of lifting the rod magnet 18 out of engagement with the cavity 17 in the name plate 7 and thus releases the name plate from locking engagement with the base member.

In FIG. 5 there is shown an arrangement of two magnets 19*a* and 20*a* located parallel with each other in the base member 6, with the magnets having opposite polarity requiring an opposite pole magnet to retract the magnets 19*a* and 20*a* from locking engagement with the name plate.

In FIG. 5*a* the magnets 19*a* and 20*a* are similar to those shown in FIG. 5. In order to permit the magnets 19*a* and 20*a* to lock with a name plate when the assembly is mounted on a flat horizontal surface, an additional magnet 21 is mounted in a fixed position at right angles and spaced from the inward ends of the magnets 19*a* and 20*a*. In this arrangement the magnet 21 pulls the magnets 19*a* and 20*a* into locking engagement with the name plate.

In FIG. 6 there is shown an arrangement of two magnets 22 and 23 which are vertically aligned with each other, one in each of the rails 9. These magnets 22 and 23 are of opposite polarity and their adjacent ends 24 together act to lock the name plate to the base 29 in the manner above described.

In FIGS. 7, 8, 9 and 10 there is shown a variation in which the round-flat magnets are used to lock the name plate to the base on which the name plate is mounted.

In FIGS. 7 and 8 the magnet 25 is mounted centrally on the left spring 26 and the magnet is seated within the aperture 27 in the rail 9*a*. The left spring 26 has its ends anchored at 28 in the longitudinal recess 10*a* in the rear face of the base member 29. The name plate 30 has a circular recess 31 formed in its rear face 32 in which the magnet 25 is normally seated when the name plate 30 is positioned on the base member 29, and is withdrawn from its seated position when the operative magnet is applied to permit the name plate to be slidingly removed from the base member.

FIGS. 9 and 10 are similar to FIGS. 7 and 8, except that two magnets 33 are employed, secured to the ends of the leaf spring 34 which is secured centrally to the rear face of the base member 35. The magnets 33 seat in the recesses 36 in the name plate 37 to hold the name plate locked on the base member 35.

In FIGS. 11, 12 and 13 there is shown an arrangement similar to FIGS. 7, 8 and 9 with the exception that round rod type magnets 38 and 38*a* are secured on the ends of the single leaf spring 39 and the double leaf spring 40.

In FIGS. 14, 15 and 16 there is shown a still further modification in which a series of name plates 41 are mounted on a board, such as a directory board 42. The means for locking the name plates 41 on the board is shown in FIGS. 15 and 16 and consists of a gang rod 43 having raised portions 44 which ride in slots 45 within the rails 46 mating with corresponding slots 47. A magnet or soft iron plate 48 in the name plates is secured to the top end of the gang rod 43.

When the operative magnet is applied close to the location of the magnet 48, the magnet or soft iron plate 48 is attracted to move upwards in the mating slots 45 and 47 and thereby withdraw the raised surfaces 44 of the gang rod 43 upwards out of engagement with the slots 47 in the lower edge portion of the name plates.

In all of the above described arrangements, the metal dowels or magnets locking the name plates to the base member on which they are mounted can only be moved out of engagement with the name plates by the application of the operative magnet, shown as an external magnet and designated A in FIG. 4, to the name plate assembly adjacent to where the locking magnet is located. For instance, the pin-type metal dowels or magnets 18 such as are shown in FIG. 3 would require the external magnet A to be applied to the top horizontal edge of the name plate assembly, and where the disc-type magnets are employed, the external magnet A would have to be applied to the outer face of the name plate in order to repulse the disc magnet out of engagement with the name plate.

In other arrangements such as where two magnets are used as in FIGS. 5 and 5*a*, a double-pole external magnet is employed to attract the two magnets away from each other to unlock the name plate from the base member.

Where an electrical supply is available, the external magnet A shown in FIG. 4 can be replaced by electromagnets built into the base member and controlled by switches or push buttons which in turn can be locked against unauthorized use.

While the base members and name plates have been illustrated having dovetailed mating surfaces, the base members could be of channel form, having lips at their longitudinal edges to retain the name plates for sliding movement in the channels.

With the above described arrangements the name plates cannot be removed from their mounting and no visible locking arrangement can be seen. One must have the knowledge that an external magnet must be used to unlock the name plate and, in certain instances such as with the arrangements shown in FIGS. 5, 5*a* and 6, the external magnet must be used in a specific way in order that the locking magnets will withdraw from locking contact with the name plate.

The embodiments of the invention in which an exclusive property or privilege is claimed are defined as follows:

1. A lockable name plate and base member assembly having theft discouraging features, said assembly comprising:

an elongate base member adapted to be fixed in place extending in a generally horizontal direction relative to a substantially vertical support surface and comprised of a generally plate-shaped base that has when said base member is so fixed a substantially vertical front face and a substantially vertical rear face which is in abutting relationship with the support surface, means for vertically mounting said base to the support surface so as to extend in a generally horizontal direction, first and second, raised spaced apart, parallel dovetailed rails integral with said base front face extending along the length thereof and forming a dovetailed slot therebetween, said base having a transversely disposed cavity centrally disposed between said front and rear faces thereof at a distance from one end thereof that is generally vertical when said base member is so fixed, said cavity extending upwards behind said rail and downwards below said rail so as to be closed behind said rail and exposed below said rail;

a lockable name plate comprised of a base having a front face and a rear face, said front face being for carrying a legend and said rear face having first and second dovetailed longitudinal recesses so as to form a centrally disposed dovetailed rail therebetween and conforming to and mating with said first and second rails and said slot such that said name plate is slidably mountable on said base member to an operative position thereon with said rear face of said name plate base abutting said front face of said base member base, said name plate base further having a transversely disposed cavity extending downwards from the lower wall of said first recess into said name plate rail and in vertical alignment with said base member cavity when said name plate is mounted in said operative position and on said base member which in turn has been so fixed; and hidden locking means for locking said name plate to said base member, said locking means being invisible and inaccessible when said name plate is mounted on said base plate in said operative position, said locking means comprising a locking member that can be moved under the influence of a magnetic force and that comprises a magnetic metal rod-shaped dowel confined for slidable movement within said base member cavity, said name plate cavity being a catch means for engaging the lower part of said locking member upon the alignment thereof with said locking member at said operative position of said name plate and said base member, said locking member being movable across the mating edges of said first base member rail and said name plate rail and mounted such that it can drop into said name plate cavity when mounted on said base member at said operative position and thereupon locking said name plate and said base member together;

said locking means being unlockable by a magnetic means for cooperating with a predetermined position on said assembly to effect withdrawal of said locking member from said catch means with only magnetic force so as to permit sliding movement and disengagement of said name plate from said base member said base member is extruded and has a larger recess in the rear face thereof located behind and in communication with said base member cavity, said base member further including a plug mounted in said larger recess being for retaining said dowel in said base member cavity.

* * * * *